US007329211B2

(12) United States Patent
Kim

(10) Patent No.: US 7,329,211 B2
(45) Date of Patent: Feb. 12, 2008

(54) BACKSWING RELEASE HANDLE

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 212 days.

(21) Appl. No.: 11/231,613

(22) Filed: Sep. 21, 2005

(65) Prior Publication Data

US 2007/0066458 A1 Mar. 22, 2007

(51) Int. Cl.
*A63B 15/00* (2006.01)

(52) U.S. Cl. ..... 482/109; 482/38; 482/44

(58) Field of Classification Search ..... 482/109; 83/859, 477, 821, 835; 30/513, 517, 166.3, 30/144; D08/95
See application file for complete search history.

(56) References Cited

U.S. PATENT DOCUMENTS 3,565,137 A * 2/1971 Alsruhe ..... 83/859
3,738,661 A * 6/1973 Moller ..... 483/229
5,356,166 A 10/1994 Hahne et al.
5,593,239 A 1/1997 Sallee
5,595,545 A 1/1997 O'Brien
6,098,294 A * 8/2000 Lemos ..... 30/513
6,370,782 B1 * 4/2002 Fleming ..... 30/517
6,537,184 B2 3/2003 Kim
6,558,302 B2 * 5/2003 Cluff ..... 482/129
6,945,918 B1 * 9/2005 Hill ..... 482/106
7,226,402 B1 * 6/2007 Joya ..... 482/121
2002/0137605 A1 9/2002 Olsen
2003/0153440 A1 8/2003 Kim
2004/0261634 A1 * 12/2004 Wang ..... 99/584

* cited by examiner

*Primary Examiner*—Lori Amerson
(74) *Attorney, Agent, or Firm*—Brown & Michaels, PC

(57) ABSTRACT

An exerciser uses a handle and bracket combined with a resistance that opens the bracket away from the handle to facilitate wrist cocking in a backswing region of a simulated swing. As the handle moves downward and forward toward a hitting region of the swing, the bracket moves to a closed position requiring the exerciser's wrists to uncock against the resistance in approaching the hitting region.

20 Claims, 4 Drawing Sheets

BACKSWING RELEASE HANDLE

BACKGROUND

A golfer can train to improve a golf swing by using a golf exerciser that involves moving a handle through a simulated golf swing while a resistance impedes the handle movement. Suitable exercisers for this purpose are shown in applicant's U.S. Pat. No. 6,537,184; and U.S. Pat. No. 7,153,245.

An important aspect of a golf exerciser that allows a person to move a handle against a resistance is allowing the exerciser to cock the wrists fully in a backswing region of a simulated golf swing and then to uncock the wrists as the simulated swing approaches a hitting region. Unless the exerciser's wrists are properly cocked in a backswing region, they cannot be uncocked against a resistance in approaching the hitting region, and a forceful uncocking of the golfer's wrists as the handle is driven into a hitting region is an important aspect of a successful golf swing. The invention of this application facilitates the cocking of the exerciser's wrists in a backswing region and the uncocking of the exerciser's wrists against the resistance in approaching the hitting region.

Other sports swings, such as baseball and hockey, can also benefit from the similar exercise involving cocking and uncocking wrists as the swing moves against the resistance. The invention that improves a golf swing exercise to facilitate wrist cocking and uncocking against the resistance also applies to similar swing exercises for other sports that also involve wrist cocking and uncocking during a swing motion.

SUMMARY

The invention of this application combines a bracket with an exercising handle that is moved through a simulated swing against a resistance. The bracket is connected to a resistance and is movable relative to the handle to facilitate cocking the exerciser's wrists in a backswing region and uncocking the exerciser's wrists against a resistance as the handle moves into a hitting region of the simulated swing. The bracket is interposed between the handle and the resistance and is mounted preferably on a proximal end of the handle. The bracket in a closed position is shaped to extend clear of a grip region of the handle to a distal end of the handle where the bracket connects to the resistance. This effectively applies the resistance to the distal end of the handle to resist handle acceleration into the hitting region.

In a backswing region of the simulated swing, the bracket moves to an open position extending away from the handle toward the resistance. This effectively applies the resistance to the proximal end of the handle so that the resistance does not impede full wrist cocking in the backswing region. Then as the handle moves toward the hitting region, the bracket pivots to a closed position effectively applying the resistance to a distal end of the handle and allowing the exerciser's wrists to uncock against the resistance as the swing approaches the hitting region. The combination of bracket, handle and resistance thus effectively helps an exerciser train and strengthen muscles to improve a sports swing.

DRAWINGS

DETAILED DESCRIPTION

The drawings are limited to a few preferred alternative combinations of exercising handle and bracket movable through a simulated golf swing having a resistance applied by an exercising device. Information on preferred embodiments of exercising devices usable with the illustrated handle and bracket combination is available in U.S. Pat. Nos. 6,537,184 and 7,153,245. The invention also applies to other simulated sports swings for exercise purposes. These include baseball, hockey, and possibly other sports involving wrist cocking and uncocking during a swing.

Figure 1:
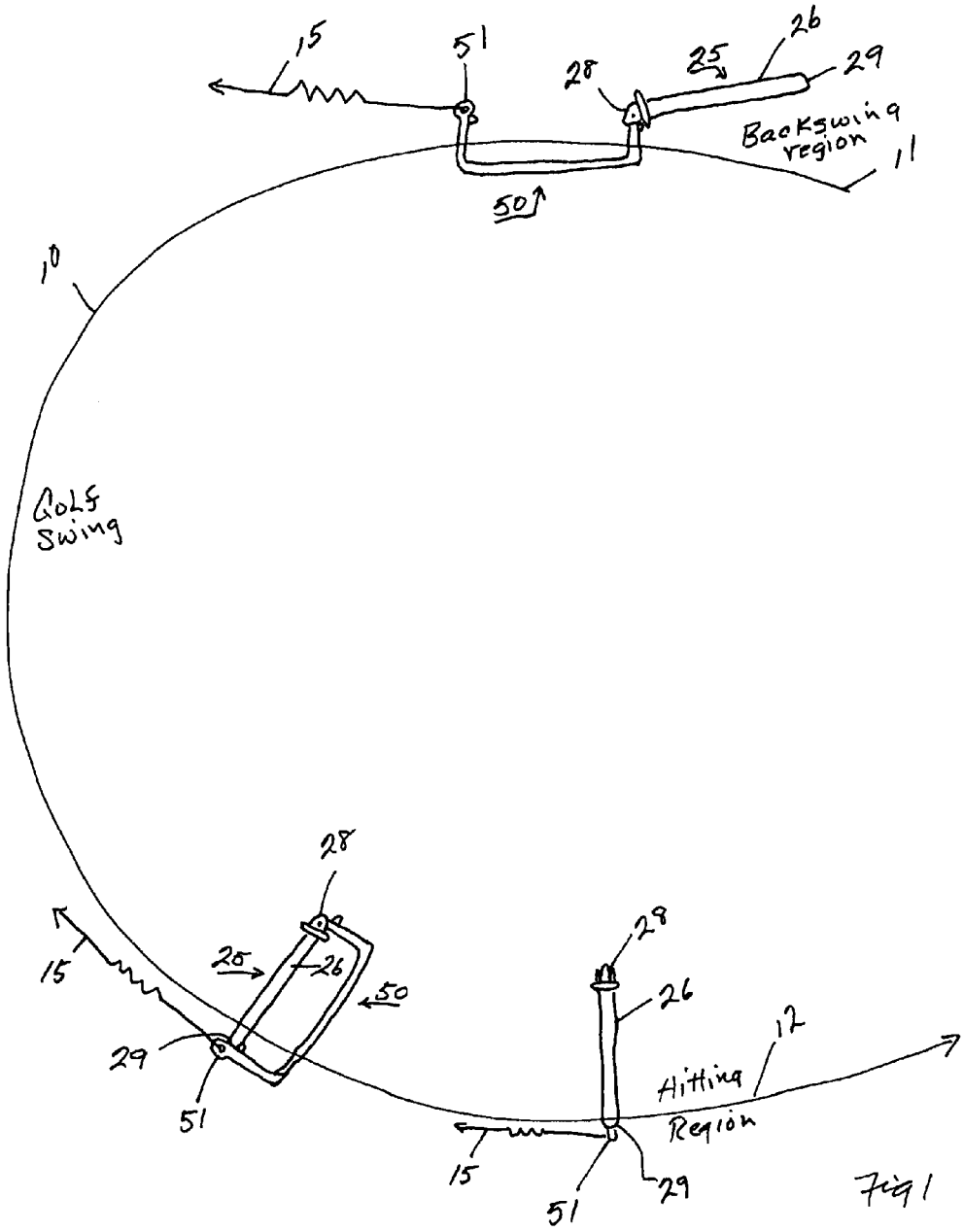
FIG. 1 is a partially schematic view showing a preferred embodiment of a handle and bracket combined with a resistance moving from a backswing region of a simulated swing to a hitting region of a simulated swing.

For simplicity, the simulated sports swing is illustrated schematically in FIG. 1 by a curved line 10 leading from backswing region 11 to hitting region 12 where the swing line has an arrow head. The resistance to movement along swing line 10 is schematically illustrated by resistance arrows 15. The bracket is shown in an open position pivoted away from the handle in backswing region 11, and the resistance has pulled the bracket back to a closed position as the handle approaches hitting region 12. In the hitting region, the handle has been rotated as the exerciser's wrists roll forward to a proper hitting orientation for the handle. The remainder of the drawings illustrates a few of the many preferred embodiments of handle 25 and bracket 50.

Figure 2:
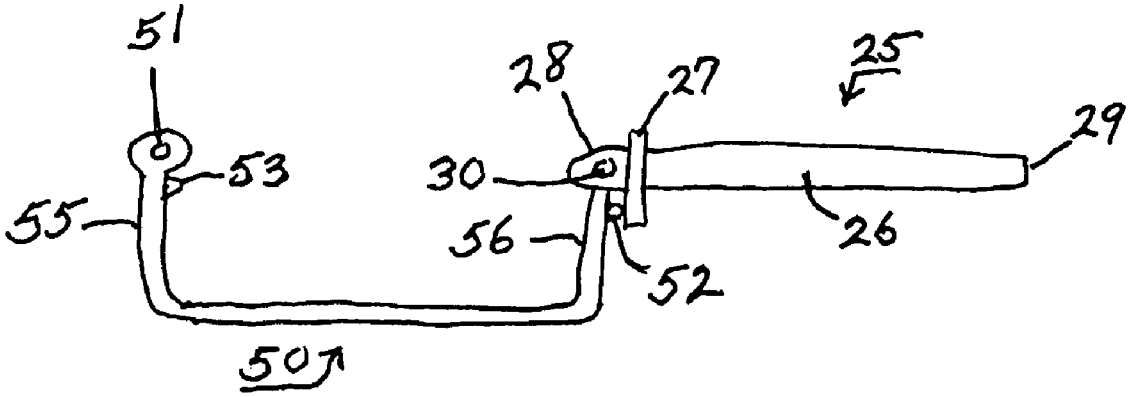
FIG. 2 is a partially schematic view of a preferred embodiment of a handle and bracket combination showing the bracket in an open position attained in a backswing region of a simulated swing.
Figure 3:
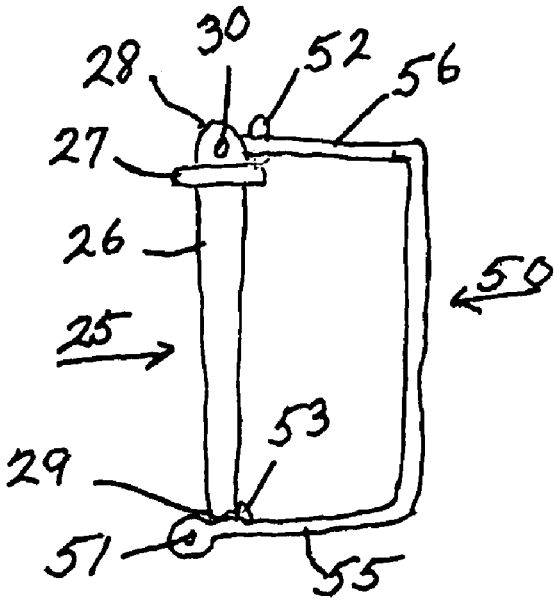
FIG. 3 is a view of the handle and bracket combination of FIG. 2 shown in a closed position of the bracket attained at the hitting region of the simulated swing.

As shown in FIGS. 2 and 3, handle 25 includes a grip region 26 engageable by both hands of a person exercising. A guard 27 preferably spaces a heel of a gripping hand away from a proximal end pivot 28 to which bracket 50 is preferably connected. Guard 27 is for comfort and convenience, and can be shaped in many ways or even eliminated. A distal end 29 of handle 25 can terminate at a distal end of grip region 26, or extend beyond grip 26 by varying amounts, depending on the exercising effect desired.

Bracket 50, as shown in FIGS. 2 and 3 is freely pivotal on pivot pin 30 at proximal end 28 of handle 25. Bracket 50 is preferably generally U-shaped, and extends from pivot pin 30 along proximal region 56 to a connection 51 to resistance 15 in distal region 55. Connection 51 can be an eyelet, hook, ring, snap connector and other forms of simple connection to a resistance cord 15.

Figure 6:
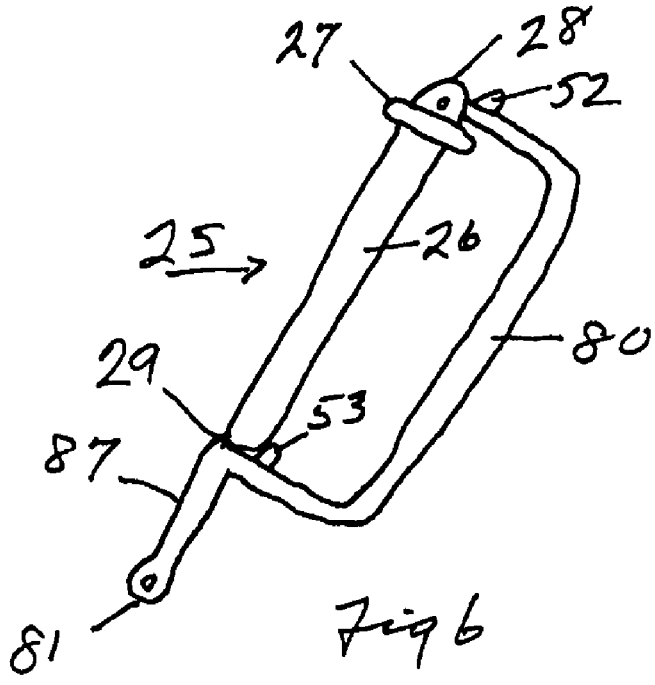
FIG. 6 is a partially schematic view from a follow through side of a hitting region position showing another preferred embodiment of a handle and bracket combination axially extending a resistance connection beyond a grip region of a handle.

An abutment stop 52 on bracket 50 preferably engages guard collar 27 or some other element of pivot 28 or handle 25 to establish the maximum open position of bracket 50, as shown in FIG. 2 and in the backswing region 11 of FIG. 1. Another abutment stop 53 is positioned near resistance connector 51 on distal end region 55 of bracket 50. Abutment stop 53 preferably engages a distal end region 29 of handle 25 in the closed position as shown in FIG. 6 and in the approach to hitting region 12 of FIG. 1. Pivot movement stops can also be incorporated into pivot mechanisms themselves, so that many workable alternatives are available for the positioning of stops or abutments to keep the freely pivotal motion of bracket 50 within acceptable limits.

Bracket 50 in either the closed position of FIG. 3 or the open position of FIG. 2 extends clear of a pair of hands holding grip region 26 of handle 25. As handle 25 is moved into backswing region 11, bracket 50, moves in response to resistance 15 to an open position shown in FIG. 2. This interposes the length of bracket 50 between proximal end 28 of handle 25 and resistance 15 to reduce the force of resistance 15 to movement into backswing region 11. This also applies resistance 15 to the proximal end 28 of handle 25 where resistance 15 does not impede a wrist cocking movement of handle 25. This encourages an exerciser to fully cock the wrists holding the handle 25 in the backswing region 11, which can occur when abutment stop 52 engages collar or guard 27.

As swing 10 proceeds from backswing region 11 toward hitting region 12, an exerciser's wrists begin to uncock, and bracket 50 begins to pivot toward a closed position in response to resistance 15. The uncocking and rolling forward of the exerciser's wrists is forcefully completed as handle 25 moves into hitting region 12 while bracket 50 is pivoted to a closed position as also shown in FIG. 3. During movement from backswing region 11 to hitting region 12 bracket 50 effectively transfers a force of resistance 15 from proximal end 27 to distal end 29 of handle 25. Since the exerciser must move the distal end of handle 25 forcefully through hitting region 12, and since resistance 15 is applied to bracket 50 near distal end 29 of handle 25, this forces an exerciser to uncock the wrists against the force of resistance 15. This can help the exerciser develop muscles needed in powerfully uncocking the wrists, and this can lead to a more forceful swing through hitting region 12.

Figure 4:
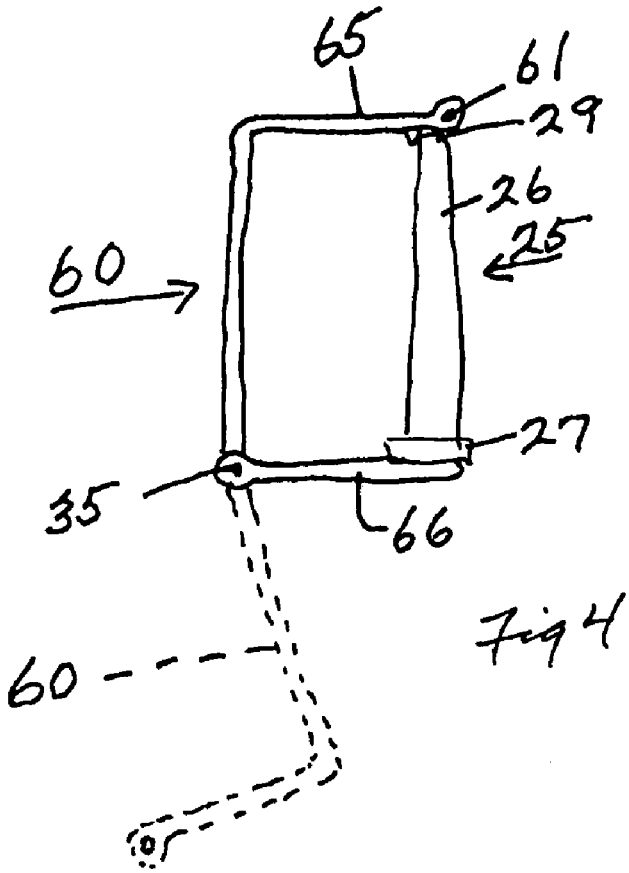
FIGS. 4 and 5 show alternative preferred embodiments of a bracket having pivotal connections in alternative positions.
Figure 5:
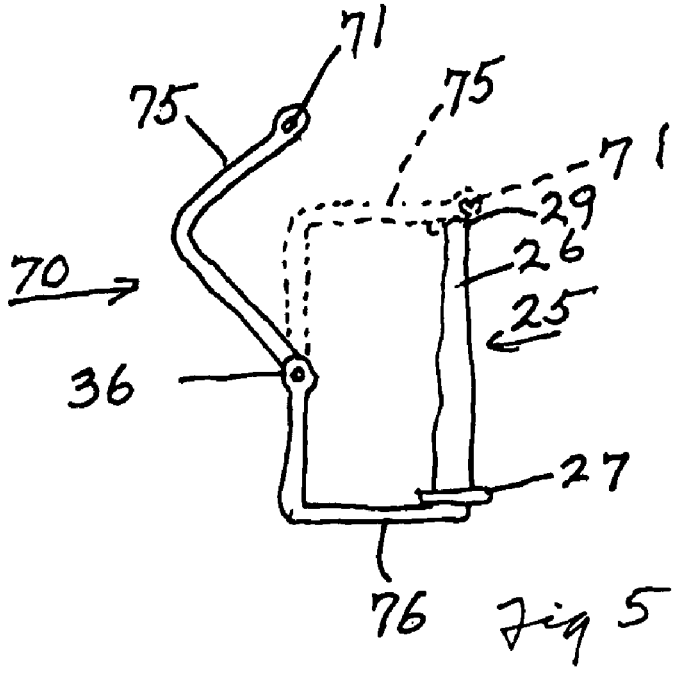

The alternative preferred embodiments of FIGS. 4 and 5 show different locations of pivot movements. Bracket 60 of the embodiment of FIG. 4 is rigidly connected to proximal end 27 of handle 25 and extends along proximal region 66 to a pivot 35. The open position of bracket 60 is shown in broken lines extending away from handle 25, and the closed position of bracket 60 is shown in solid lines leading to distal end region 65 and a resistance connection 61 near distal end region 29 of handle 25.

Bracket 70 of the embodiment of FIG. 5 is also fixed to proximal end 27 of handle 25 and extends along proximal end region 76 to a pivot 36 spaced a little farther from proximal end 27. A partially open position of bracket 70 is shown in solid lines in FIG. 5, and a closed position of bracket 70 is shown in broken lines. From pivot 36, bracket 70 extends to distal end region 75 and resistance connection region 71, which is near distal end region 29 of handle 25 in the closed position of bracket 70.

The working effect of brackets 60 and 70 is similar to the working effect of bracket 50 in facilitating wrist cocking at backswing region 11 and wrist uncocking against resistance 15 in hitting region 12. The illustrations of FIGS. 4 and 5 also show that a suitable bracket combined with exercising handle 25 can be configured in several different and acceptable ways.

The alternative preferred embodiment of FIG. 6, which views handle 25 from a follow through side of a hitting region position, differs from the embodiment of FIGS. 2-5 by providing bracket 80 with an axial extension 87 that places resistance connector 81 axially beyond distal end 29 of grip region 26 of handle 25. The length of extension 87 affects the amount of effort required to uncock the wrists against resistance 15 as handle 25 moves into hitting region 12. Extension 81 can be made variable in length and adjustable to accommodate an exerciser's needs.

Figure 7:
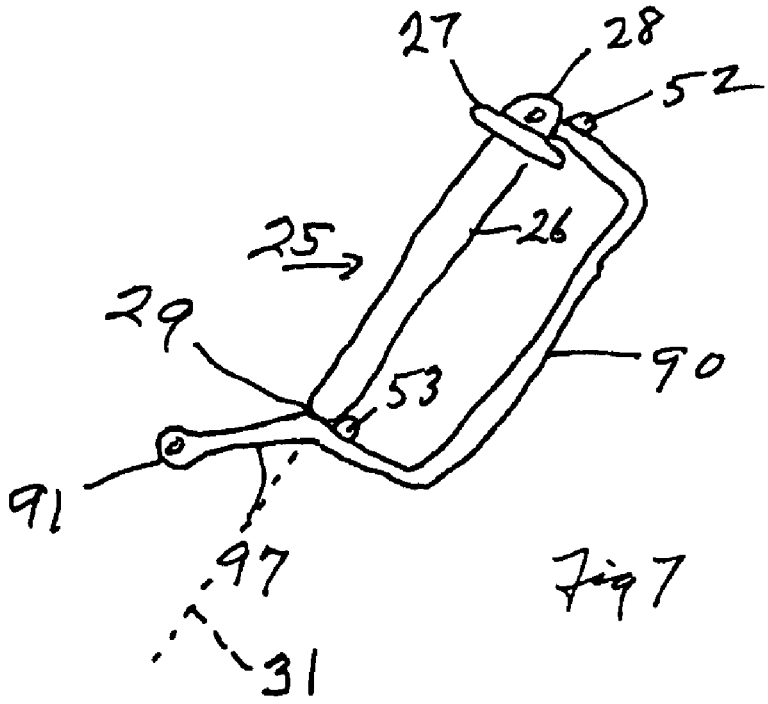
FIG. 7 illustrates another preferred embodiment viewed similarly to FIG. 6 and showing an axially off-set connection of the bracket to a resistance.

The alternative preferred embodiment illustrated in FIG. 7 is viewed similarly to FIG. 6 to show that a bracket extension 97 can also be offset from handle axis 31. A resistance attached to connector 91 in a position offset from handle axis 31 can apply a torque force to grip region 26, and an exerciser can then develop muscles needed to resist such a torque force. Several different combinations of bracket extensions 97 can extend away from and along the direction of handle axis 31. These can also be made adjustable to vary the amount of any offset from axis 31 and the distance of any extension along axis 31.

What is claimed is:

1. An exercise apparatus including a handle for practicing a swing through a simulated swing for exercise, and a resistance applied relative to the handle and bracket to resist movement of the handle through the simulated swing, the exerciser apparatus comprising:

a bracket connected to a proximal end of the handle;

the bracket including a pivot;

the bracket being pivotal between a closed position in which a distal end of the bracket is near a distal end of the handle and an open position in which the distal end of the bracket is remote from the handle;

the resistance being applied to the distal end of the bracket; and the bracket being oriented relative to the resistance of the user's movement and to the pivot movement so that the bracket moves in response to the resistance to the open position when the handle is in a backswing region of the swing, and the bracket moves in response to the resistance to the closed position as the handle approaches a hitting region of the swing.

2. The exercise apparatus of claim 1 wherein the bracket extends away from a proximal end of the handle in a direction of the resistance in the open position to facilitate cocking the wrists of the exerciser in the backswing region.

3. The exercise apparatus of claim 1 wherein the bracket moves to the closed position as the handle approaches the hitting region, which disposes the resistance near the distal end of the handle and facilitates uncocking the wrists of the exerciser against the resistance.

4. The exercise apparatus of claim 1 wherein a connection of the resistance of movement to the bracket in the closed position of the bracket is offset from an axis of the handle.

5. The exercise apparatus of claim 1 wherein the pivot is arranged near the proximal end of the handle.

6. A handle and bracket combined with a resistance of an exerciser comprising:

the bracket having a pivot and being connected to a proximal end of the handle;

the bracket in a closed pivot position extending clear of a grip region of the handle to a distal end of the bracket arranged near a distal end of the handle;

the bracket in an open pivot position extending away from the handle in a direction of the resistance; and the distal end of the bracket being connected to the resistance.

7. The exerciser of claim 6 wherein the bracket in the open position applies the resistance to the proximal end of the handle to facilitate cocking of an exerciser's wrists in a backswing region of a simulated swing.

8. The exerciser of claim 6 wherein the bracket in the closed position applies the resistance to a distal end of the handle to resist uncocking an exerciser's wrists as a simulated swing approaches a hitting region.

9. The exerciser of claim 6 wherein the bracket interposes its length between the proximal end of the handle and the resistance in a backswing region of a simulated swing, and aligns its length with a length of the handle in the closed position to increase the resistance to handle movement into a hitting region of a simulated swing.

10. The exerciser of claim 6 wherein the pivot is arranged near the proximal end of the handle.

11. A handle and resistance combination arranged so that an exerciser can move the handle against the resistance in a simulated swing for exercise purposes, the combination comprising:

a bracket interposed between the handle and the resistance, the bracket being connected to the resistance and being movably connected to a proximal end of the handle;

the bracket being oriented relative to the handle and to a direction of the resistance so that the bracket is moved by the resistance away from of the handle when the exerciser's wrists are cocked in a backswing region of the swing; and the bracket is moved by the resistance toward a distal end of the handle as the handle approaches a hitting region of the swing so that the resistance is applied to resist uncocking the exerciser's wrists in approaching the hitting region.

12. The handle and resistance combination of claim 11 wherein the resistance is connected to a distal end of the bracket.

13. The handle and resistance combination of claim 12 wherein the connection of the resistance to the distal end of the bracket is offset from an axis of the handle in the closed position of the bracket.

14. The handle and resistance combination of claim 11 wherein the bracket extends from the proximal end of the handle clear of a grip region of the handle to a distal end of the handle where the bracket connects to the resistance.

15. The handle and resistance combination of claim 11 wherein the bracket includes a pivot and pivotally moves toward and away from the handle.

16. An exerciser including a handle movable through a simulated swing and a resistance applied to resist movement of the handle through the simulated swing, the exerciser comprising:

a bracket connected to the resistance and movably connected to a proximal end of the handle, the bracket being oriented on the handle and being responsive to the resistance to move between an open position at a backswing region of the swing where the exerciser's wrists are cocked and a closed position near a hitting region of the swing where the exerciser's wrists uncock;

the bracket in the open position applying the resistance to the proximal end of the handle; and the bracket in the closed position applying the resistance to a distal end of the handle.

17. The exerciser of claim 16 wherein the bracket in the closed position applies the resistance to resist uncocking the exerciser's wrists.

18. The exerciser of claim 16 wherein the bracket in the open position applies the resistance to facilitate cocking of the exerciser's wrists.

19. The exerciser of claim 16 wherein the bracket extends from the proximal end of a handle clear of a grip region of the handle to a distal end of the handle where the bracket connects to the resistance.

20. The exerciser of claim 16 wherein the connection of the bracket to the handle is pivotal.

* * * * *